US006173656B1

(12) United States Patent
Blanchard

(10) Patent No.: US 6,173,656 B1
(45) Date of Patent: Jan. 16, 2001

(54) LAP TABLE FOR CHILDREN

(76) Inventor: David K. Blanchard, Dave Blanchard Ventures Inc., 66 Northam Ct., Slidell, LA (US) 70458

( * ) Notice: Under 35 U.S.C. 154(b), the term of this patent shall be extended for 0 days.

(21) Appl. No.: 09/281,225

(22) Filed: Mar. 30, 1999

(51) Int. Cl.[7] ..... A47B 23/00
(52) U.S. Cl. ..... 108/43
(58) Field of Search ..... 108/43, 44, 45; 248/444

(56) References Cited

U.S. PATENT DOCUMENTS

| | | | | |
|---|---|---|---|---|
| D. 280,216 | | 8/1985 | Boklund . | |
| D. 329,547 | | 9/1992 | Hageman . | |
| D. 374,357 | | 10/1996 | McCray et al. . | |
| 2,640,747 | | 6/1953 | Bodenhoff . | |
| 2,647,678 | * | 8/1953 | Olson | 108/43 X |
| 2,808,191 | | 10/1957 | Cramer . | |
| 2,979,990 | * | 4/1961 | Alexander | 108/43 X |
| 3,172,636 | * | 3/1965 | Collier | 248/444 |
| 4,700,634 | * | 10/1987 | Mills et al. | 108/43 |
| 4,976,204 | * | 12/1990 | Konkle | 248/444 X |
| 5,081,936 | * | 1/1992 | Drieling | 108/43 |
| 5,381,717 | * | 1/1995 | Brokaw | 108/43 X |
| 5,460,102 | * | 10/1995 | Pasmanick | 108/43 |
| 5,560,676 | | 10/1996 | Griffith et al. . | |
| 5,680,973 | | 10/1997 | Vulpitta et al. . | |
| 5,732,910 | * | 3/1998 | Martin | 108/43 X |

* cited by examiner

*Primary Examiner*—Jose V. Chen
(74) *Attorney, Agent, or Firm*—Richard C. Litman

(57) ABSTRACT

A portable lap table to be used by small children for travelling in a vehicle. The lap table includes a kidney shaped board surface, a center support structure, and the center support structure being arched and contoured to fit the user's thighs for comfort and stability. The table's top surface may have various recesses for holding crayons, drinks, and the like, a gutter for containing liquid spills, an outer lip to prevent objects from rolling off the surface, and handles for portability.

7 Claims, 6 Drawing Sheets

LAP TABLE FOR CHILDREN

BACKGROUND OF THE INVENTION

1. Field of the Invention

The present invention relates to a lap table for children, and is more particularly concerned with a table top for use in a motor vehicle.

2. Description of the Related Art

Families have been spending more time in their vehicles for many reasons such as work schedules and vacationing. Keeping children occupied for long periods of time while traveling in a vehicle has always been a problem for some parents. There are not very many flat surfaces in the passenger seats of vehicles for children to draw. For this reason, lap boards or tables have been the subject of earlier patents.

Lap tables have been the subject of both earlier design and utility patents. Earlier design patents have ornamental designs of table top surfaces which include squared, rectangular, and circular. Unfortunately, many table top edges that embody sharp corners can pose a safety problem if the vehicle is involved in an accident or stops suddenly, and other passengers could be injured by the sharp corners as well. Another safety problem that could occur in the above situation is that the board's flat shape could cut into the child's abdomen. There is a need for a lap table designed to prevent sharp table top edges from injuring a child in this manner.

U.S. Des. Pat. No. 280,216, issued to Carl Boklund on Aug. 20, 1985 is a box-shaped lap table with an interior storage compartment. Attached to the bottom compartment of the table is a partially opened top to give the user access to the inner compartment. The upper surface of the lid area is a blackboard used for drawing with chalk. Unfortunately, this design sits too high on a child's lap, for this reason, children cannot rest their arms comfortably on the table top's surface. An ideal design for a lap table would allow the child to rest their arms on the table top's surface comfortably to draw. This prior art patent is too high for the child to rest their arms on the table's top surface. Therefore, it should be desirable that the table top be no higher than the child's elbows.

U.S. Des. Pat. No. 329,547, issued to Hugh Hageman on Sep. 22, 1992 is an ornamental design consisting of a rectangular shape lap table top with several holding wells in a smaller rectangular shaped extension located at the distal front side. A single plastic U-shape handle is attached to the opposite side panel for carrying purposes. The location of the handle on this device would be very uncomfortable for the user if the handle is pressed against the user's abdomen.

U.S. Des. Pat. No. 374,357, issued to McCray, et al. on Oct. 8, 1996 is an ornamental design of another lap table consisting of a square table top with a downward perpendicular lip to be supported on the user's thighs. A clip is attached above the lip on the top of the desk to hold various flat items in place. One side of the desk top which comes in contact with the user has a shallow concave shape to fit the shape of the user's belly. A small straight strip is attached alongside the tip of the concave depression on the surface of the desk top.

Lap tables or boards have been the subject of earlier utility patents. Like the design patent mentioned above, U.S. Pat. No. 2,640,747, issued to George Bodenhoff on Jun. 2, 1953 is an earlier utility patent of a table top which is square in shape but has one side contoured to fit the abdominal area of the body and a foldable supporting member or leg contoured to fit perpendicularly on the thighs of the users. The supporting member that sits on the user's thighs in patents by McCray et al. and G. Bodenhoff can be very uncomfortable to the user for long periods of time due to the concentration of the table's weight distributed to a small area across both thighs.

U.S. Pat. No. 2,647,678, issued to Douglas Olson on Aug. 4, 1953 describes a lap table which is circular in shape with raised sides that function to secure paper plates. A thin half-moon shaped gripping structure is hinged to the bottom of the table for the knees to grip and can be folded parallel with the table. Although this would be useful for holding paper plates filled with food, the raised edges would make it very difficult for a child to use the table's top surface to draw on.

U.S. Pat. No. 5,560,676, issued to Griffith, et al. on Oct. 1, 1996 describes a desk which is not placed on the lap, but mounted in the passenger seat and held by the vehicle's lap belt to adjust the height of the top of the desk and leveling of the desk. A slide that is movable from the desk top extends toward the driver's seat. The desk has various sized recesses to hold office supplies, cups, portable computer, and eyeglasses. This device is specifically design for an adult and would not be very practical for a child.

U.S. Pat. No. 2,808,191, issued to Charlotte Cramer on Oct. 1, 1957 describes a disposable foldable lap tray for food and beverages. The tray is comprised of cardboard and its design includes a top, bottom, rear, and side panels where the side panels have locking members which also function as U-shape handles. There are no recesses, instead, the top panel has partially perforated areas which can be pushed through to hold glasses/cups and various sized plates. The partial perforations in the top panel would make it difficult for a child to draw on.

U.S. Pat. No. 5,680,973, issued to Vulpitta, et al. on Oct. 28, 1997 describes a carrying bag with shoulder straps. The carrying bag includes a front side wall, a rear side wall and edge walls extending therebetween which define a main compartment. It has zippered side compartments and a clip on the top surface for holding items. The bag has a box-like shape so that it may be used as a writing surface.

Children need a lap table that can be easily transported by carrying it using its handles. It should contain features in the design shape to lessen the risk of injury to both the user and to others. Lap tables have been known to cause some tension on the user's back. A lap table should be able to sit comfortably on the user's thighs for long periods of time with causing discomfort.

None of the above inventions and patents, taken either singularly or in combination, is seen to describe the instant invention as claimed. Thus a lap table for children solving the aforementioned problems is desired.

SUMMARY OF THE INVENTION

The lap table for children has a kidney shaped table top mounted on a center support structure designed for comfort, safety, stability, portability and to elevate the frontal area of the table top. The joints between the table top and the center support are arched and shaped to fit a child's thighs. The edges of the center support structure are rounded as a safety feature. In case of an accident or a sudden stop made by the vehicle, the rounded edges are less likely to puncture the user's belly or groin area. The bottom and ends of the center support structure are rounded, also as a safety feature.

The lap table may contain a storage compartment in its center support structure which can be accessed from the table top's surface through a trap door connected by a living hinge . The kidney shaped table top provides extended edges for resting the user's arms and also distributes pressure over a wider area. The kidney shape does not contain any sharp edges or protruding handles towards the user's abdomen that might injury. Handle openings in various areas with the lap table make portability easy.

Specially designed recesses are used to hold various items and are positioned in the lap table to provide easy access to the items. A recess has been included to interchangeably hold standard crayon boxes, different sizes of fast food restaurant french fry containers, and standard shape drink boxes. Small cylindrical wells are designed to hold writing and drawing instruments like pens, pencils and especially crayons upright to allow the user to easily pick the proper color drawing instrument. Gutters on the top of the board's surface are positioned to capture any spilled liquids. Deep recesses may also be located on the top of the board's surface for writing and drawing instruments. There is a lip that is raised from the outer edges of the board's surface to prevent items from rolling off the edges.

Accordingly, it is a principal object of the invention to provide a lap table for children designed for comfort, safety, and portability.

It is another object of the invention to provide a lap table having a surface suitable for drawing and eating on.

It is a further object of the invention to provide a lap table which allows the user to store various items and instruments that would be used in drawing.

Still another object of the invention is to design the lap table to ensure stability of the table top's surface in that it does not slip off the sides of the user's thighs and sits comfortably on the user's lap for long periods of time.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

These and other features and advantages of the present invention will become apparent from consideration of the following specification when in conjunction with the accompanying drawings in which.

Similar reference characters denote corresponding features consistently throughout the attached drawings.

DETAILED DESCRIPTION OF THE PREFERRED EMBODIMENT

Figure 1:
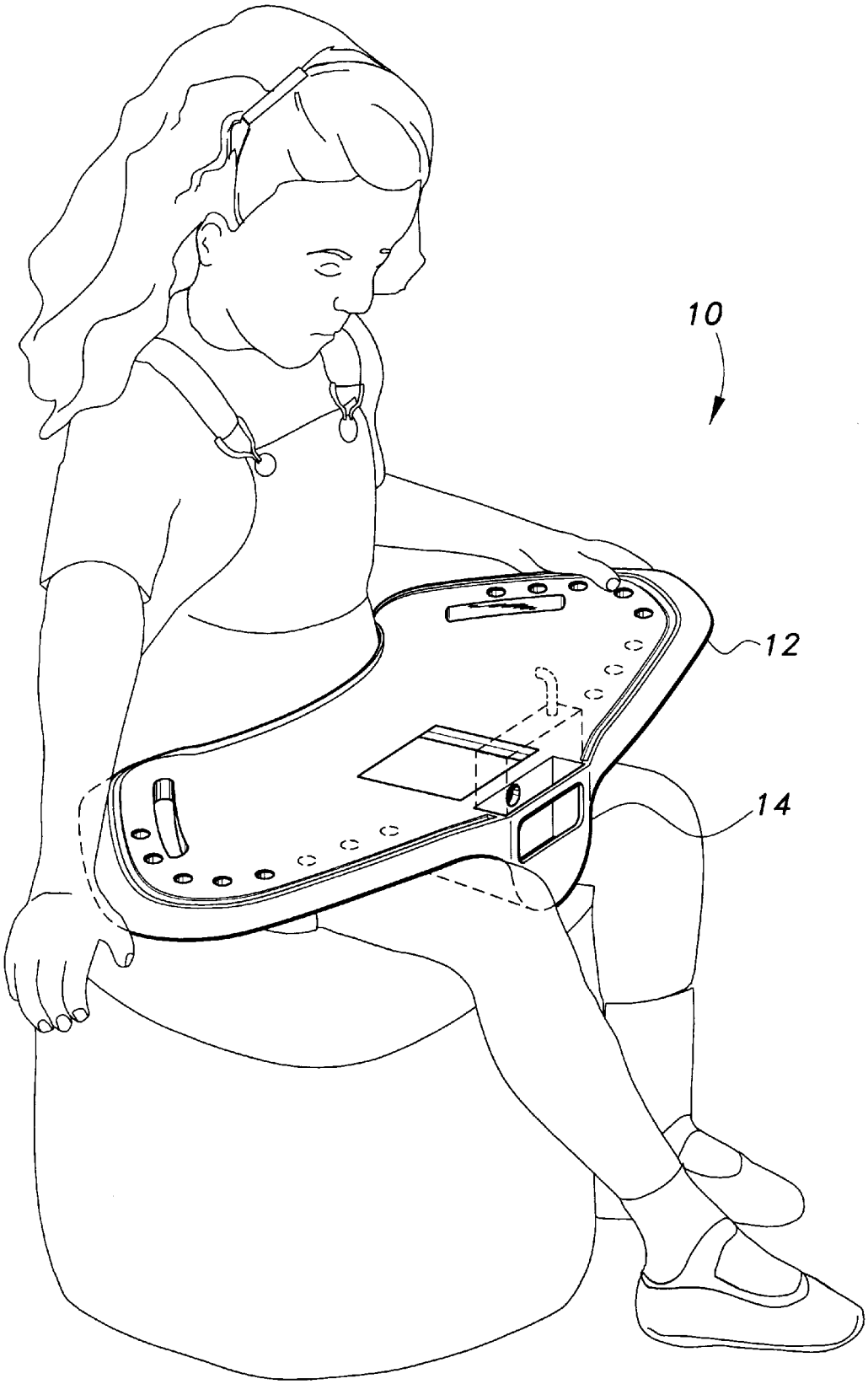
FIG. 1 is an environmental perspective view of a lap table according to the present invention in use by a small child.
Figure 2:
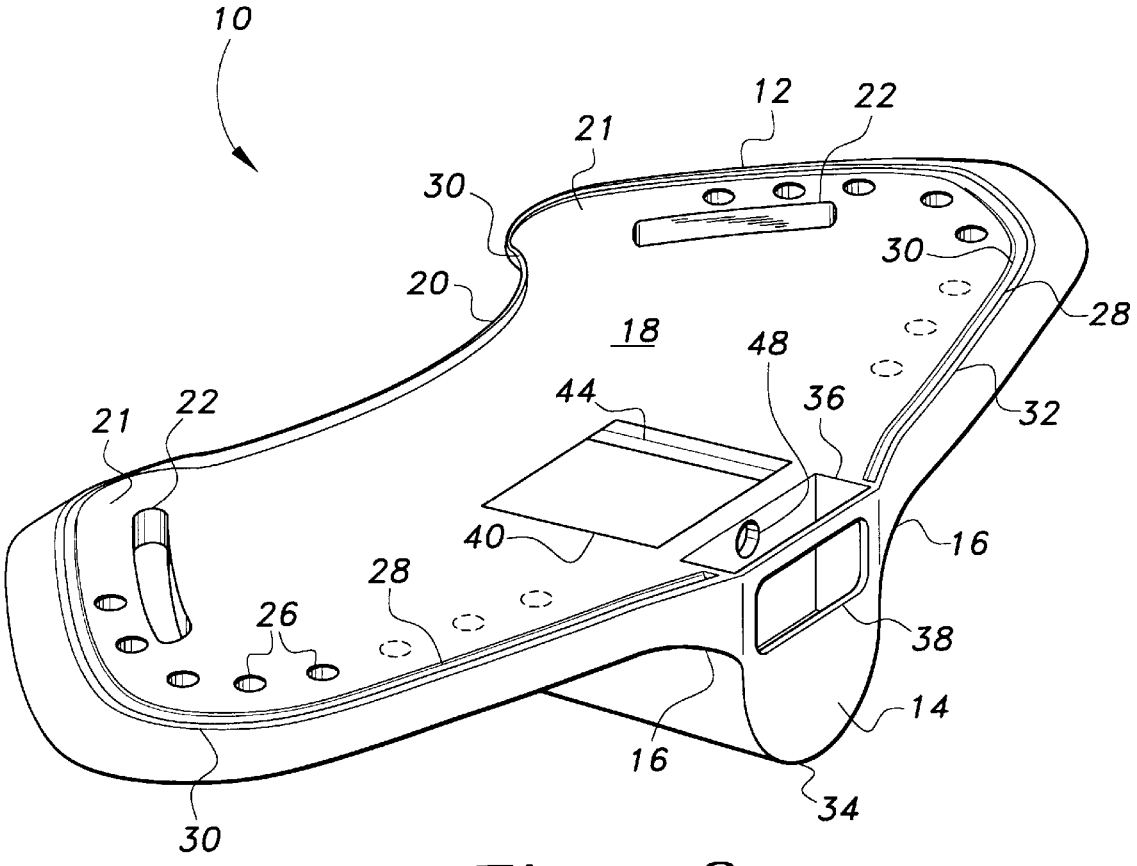
FIG. 2 is a front perspective view showing the lap table according to the present invention.

The present invention is a lap table for children, designated as 10 in the drawings. FIGS. 1 and 2 show a substantially flat kidney shaped table top 12 with a center support 14 depending from the bottom of the table top 12. The joints 16 between the table top 12 and the center support 14 are arched or flared, being contoured to fit over a child's thighs as the table 10 sits in the child's lap. The kidney shaped table top 12, the center support 14, and the arched joints 16 are designed for comfort, stability, safety and portability.

As shown in FIG. 2 the kidney shape of the table top 12 is designed to allow its right and left lobes 21 to extend outward far enough for the user's arms and elbows to work and rest comfortably on the table's top surface 18. An inward contoured shape 20 of the table top's rear edge 20, the rear edge 20 being arcuately shaped and concave inward, is dimensioned and configured to receive a portion of the user's abdomen. The inward contoured shape of the table's rear edge 20 can be thickened with padding for comfort of the user. For safety advantages, the kidney shape eliminates sharp corners that could easily injure others in the vehicle in case of an accident or sudden stops and increases the surface area bearing on the user.

Figure 3:
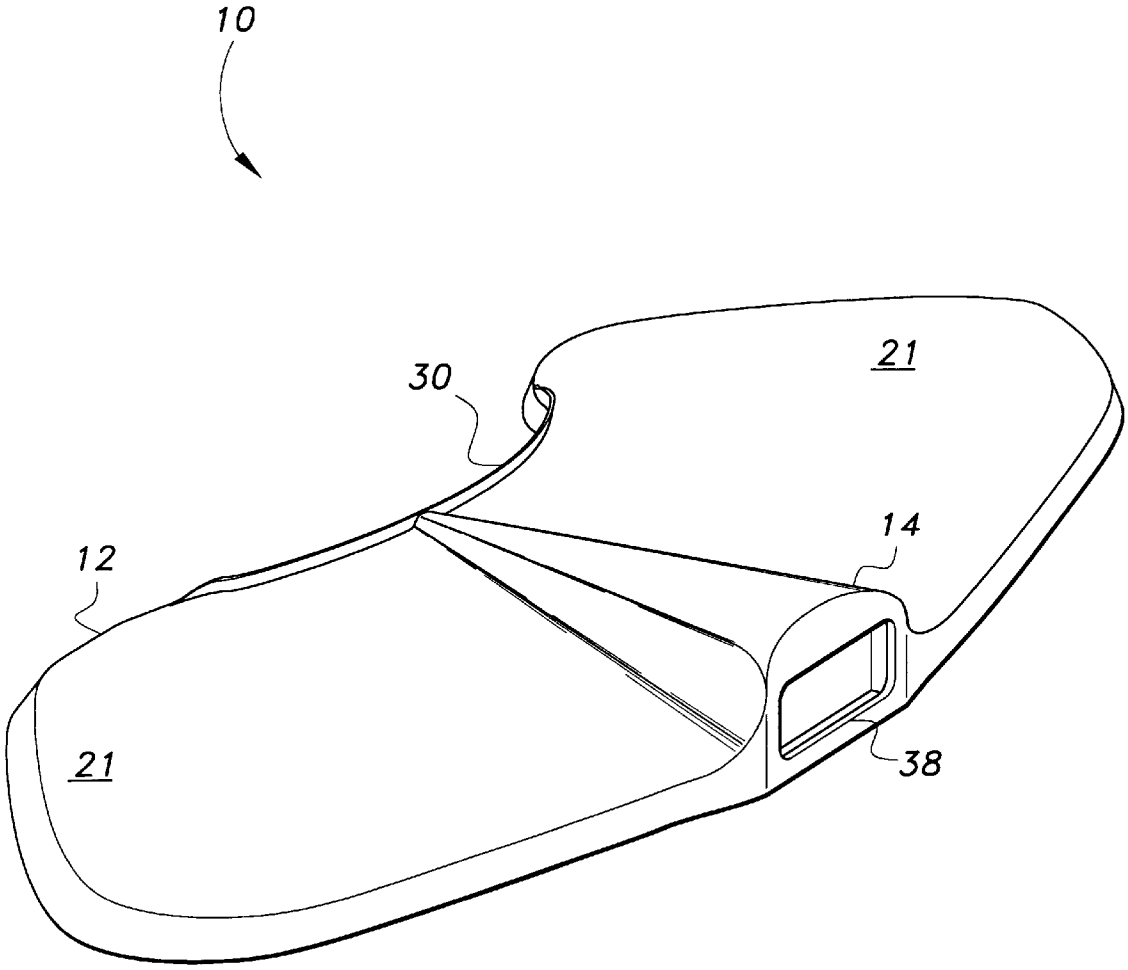
FIG. 3 is a rear perspective view showing the lap table according to the present invention.

The center support 14, shown more particularly in FIG. 3, is hollow and positioned beneath the table top and extends from the front edge 32 to the rear edge 20 of the table top 12. The center support 14 has a box holder 36 defined therein at the front 32 of the table top 12, the box holder 36 being a rectangular parallepiped shaped hole in the center support 14. The center support 14 of the lap table 10 increases in width and depth from the rear edge 20 of the table 10 to the front 32. The outer edges 34 of the center support 14 are rounded. The center support 14 is design for stability, comfort, safety, portability and to elevate the front area of the table top. As the center support 14 rests between the child's thighs, it prevents the table top 12 from sliding, shifting, and rotating off the child's lap. When the center support structure 14 is positioned between the legs it also aids in centering the table 10 in the child's lap.

As shown in FIG. 3 the center support structure 24 and its arched joints 16 allow for the weight of the lap table to be equally distributed over a larger area of the user's thighs. Lap tables that are subjects of earlier patents concentrate the weight of the lap table only in a small area across the top of the user's thighs. The concentrated weight of the table on the user's thighs prevent the table from being used for long periods of time. As shown in FIG. 3 the arched joints 16 extending out from the center support structure 24 this allows the user to support the kidney shaped lap table 10 for a longer period of time than the earlier patented lap tables.

The arched joints 16 also aid in balancing the table top 12 equally over the child's thighs preventing the table top 12 from tipping to one side when the weight of the table 10 is uneven. Since the arched joints 16 fit the shape of the child's thighs, it adds further support in preventing the table top from shifting to the left or right of the user.

Lap tables that rest parallel to the user's thighs can cause tension to the user's back. To eliminate this problem, the design of the center support 14 gradually thickens in depth and width towards the front 32 of the table top 12. This design allows the front area 12 of the table 10 to be slightly angled higher than the rear 20 of the table 10. The center support 14 functions to heighten the front 32 of the table top 12 for the user's comfort to alleviate any tension that would be caused to the user's back.

Figure 6:
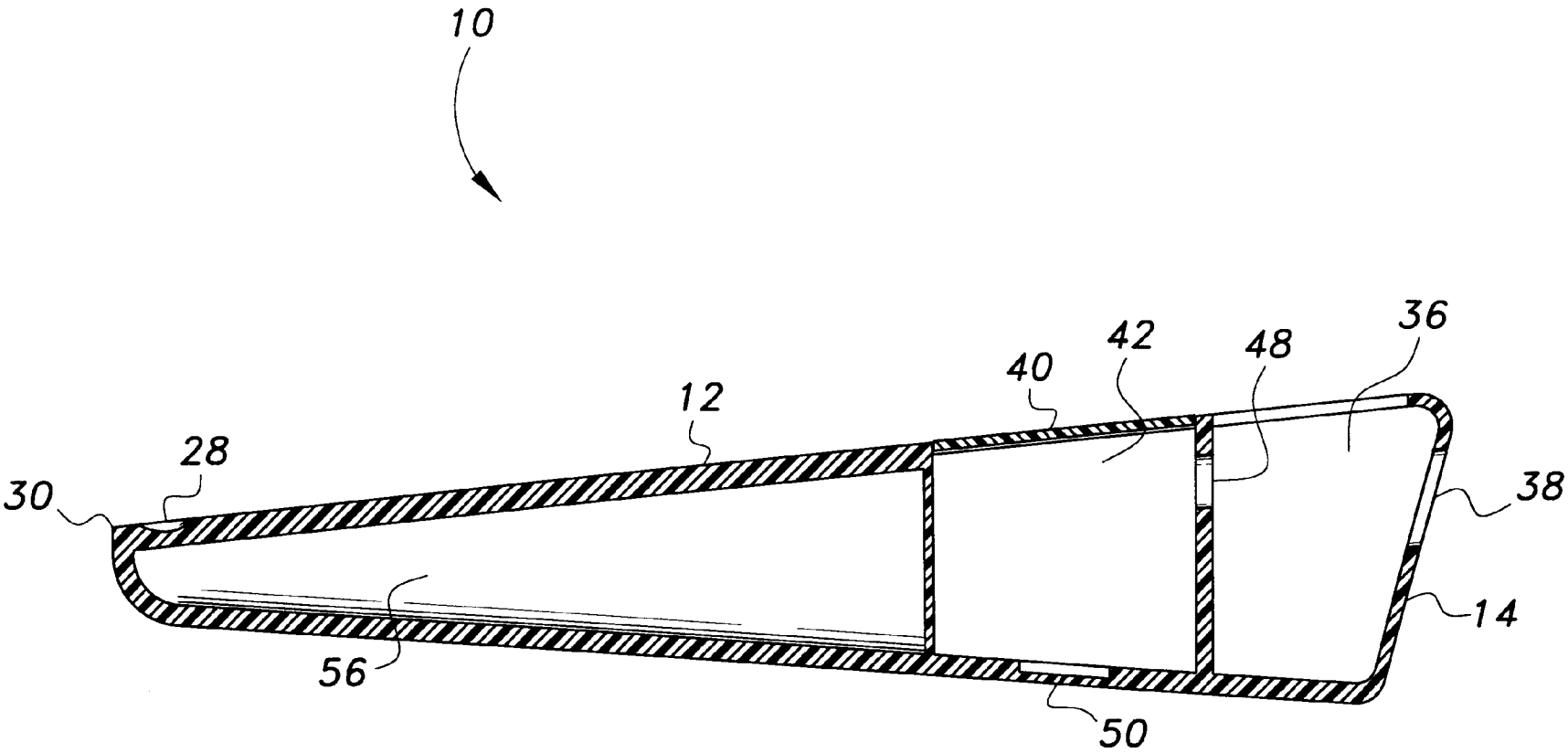
FIG. 6 is a section view taken along line 6—6 of FIG. 5.

As shown in FIG. 6 the center support 14 can be dimensioned and configured to function as a storage compartment 42 which is accessed through a trap door 40. As shown in FIG. 3 the table's top surface contains a trap door 40 located directly above the center support 14 which operates as the storage compartment 42. The trap door's opening mechanism is controlled by a living hinge 44. The living hinge 44 comprises two thicker plastic components or sections connected by a thinner layer of plastic that may be scored. The thin layer acts like a hinge.

Figure 5:
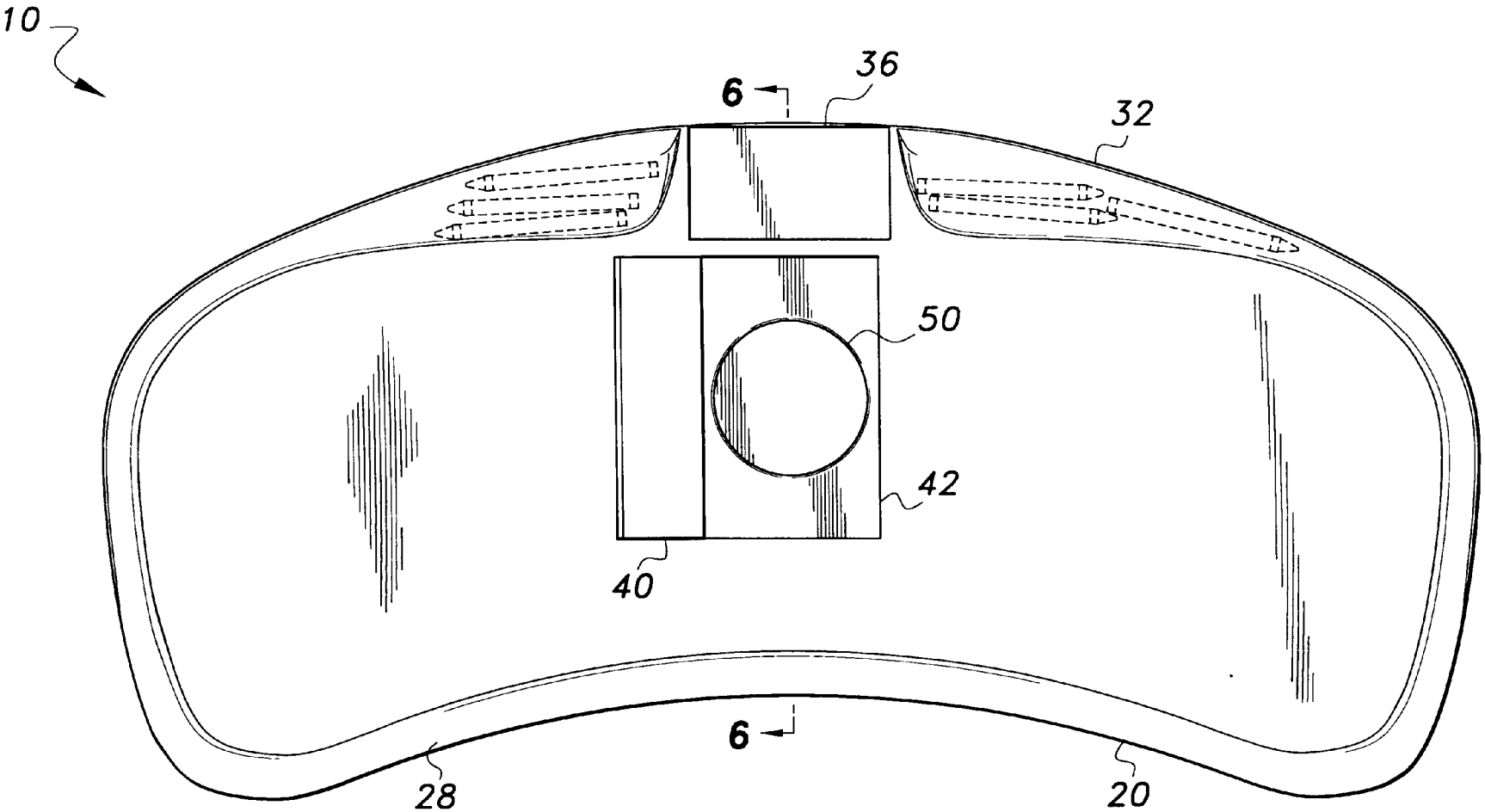
FIG. 5 is a plan view of an alternative embodiment of a lap table according to the present invention.

As shown in FIG. 6 the user opens the trap door 40 by placing one's finger through the box holder 36 located beside the trap door 40. The finger then follows through the finger access hole 48 into the storage compartment 42 and then pushes up against the underside of the trap door's surface thereby popping the trap door 40 in the open position. Once the trap door 40 is in the open position, it reveals a storage compartment 42 located in the center support 14 to store various items and drawing instruments. As shown in FIG. 5 a circular recess 50 is located on the bottom surface of the storage compartment 42 to fit a standard size drink cup from fast food restaurants.

For comfort and safety, all the edges of the center support structure 14 are completely rounded. In case of an accident or a sudden stop made by the vehicle, the rounded edges are less likely to puncture the users belly or groin area. As shown in FIG. 6 the rear inside 56 of the center support structure 24 is hollow to make the lap table 10 light in weight.

Figure 4:
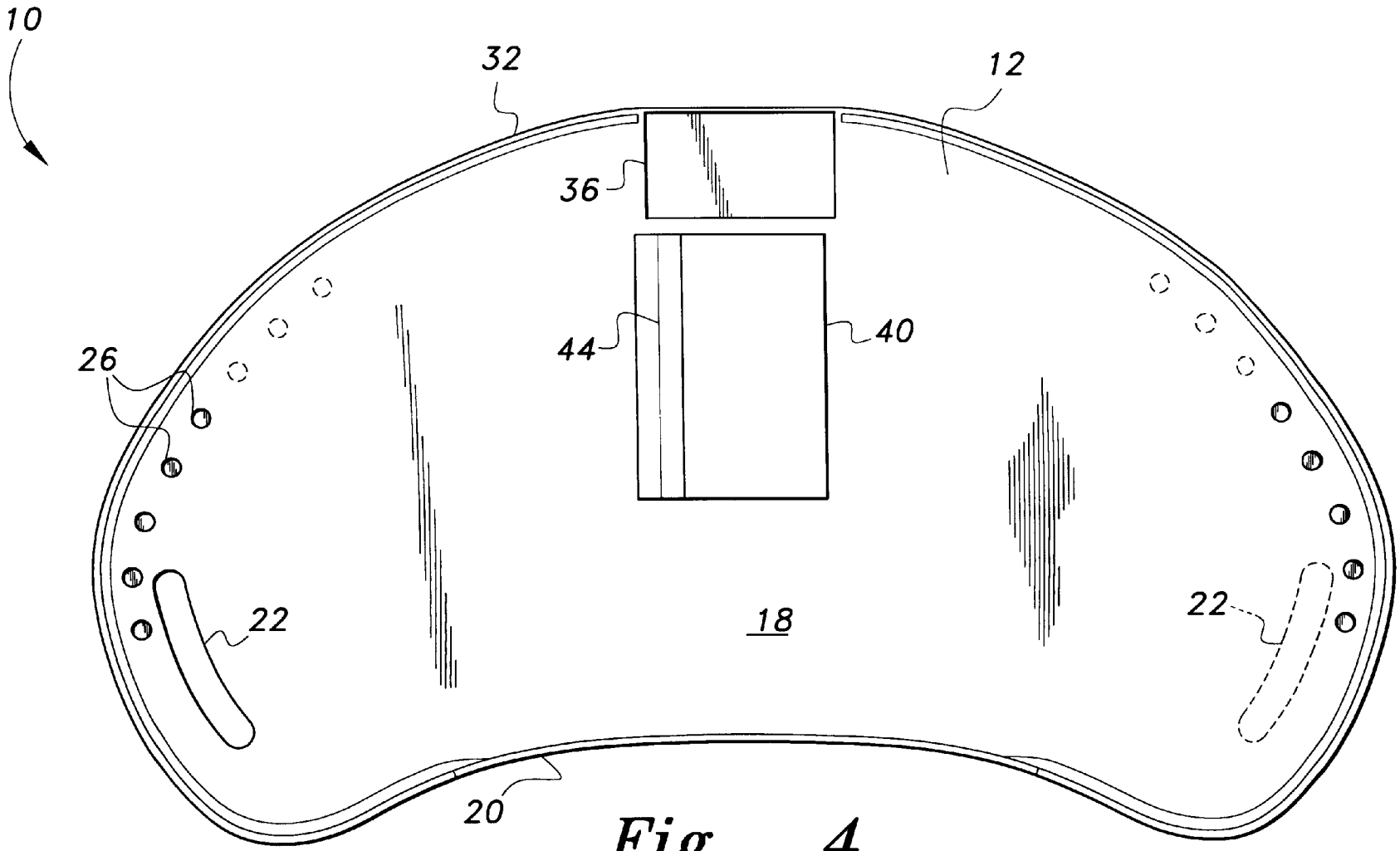
FIG. 4 is a plan view of the lap table according to the present invention.

As shown in FIG. 4 the kidney shaped table is made with openings 22 dimensioned and configured to fit a child's hand located on the left and right side of the table top to function as handles. The handle openings 22 can either be on both sides of the table top or only on the left or right side. The handle openings 22 located on both sides of the table top work to prevent the table top from tilting to one side when moving the lap table from the user's lap to another surface. These handle openings 22 on the table top allows a left or right handed user to hold the table while walking with the center support 14 facing outward from the user. This prevents the center support 14 from striking the user's leg.

One major problem traveling in a vehicle with children using crayons is that the crayons tend to mark-up the interior of the vehicle. Lap tables subject of earlier patents contain shallow depressions to hold pens, pencils, and crayons that can roll off the table when the vehicle is in motion. Instead of a shallow depression on the table top's surface, FIG. 4 shows small cylindrical wells 26 defined in the table top 12 which are dimensioned and configured to hold pens, pencils and especially crayons upright to prevent the drawing instruments from rolling off the table. In the present invention, the wells 26 would also fit the fat crayons that have recently flooded the market place. As shown in FIG. 4, the cylindrical wells 26 may be strategically located along the outer frontal edge 32 or placed at the right and left of the kidney shaped table top 12 for children who are left or right handed only.

The problem with children getting crayon marks all over the interior of the vehicle would not only be solved by the wells 26, but also through deep gutters 28, and an outer lip 30. The top surface 18 of the table top 12 may include a gutter 28 or an outer lip 30 that gradually extends on the table's outer edges to capture moving items or any split liquids. As shown in FIG. 5 the gutter size 28 is shallow near the front 32 of the lap table's edge and gradually increases in width and depth as it extends to the rear edges 34 of the table top 12. A lip 30 is raised from the outer edges of the table's surface serves as extra protection in preventing items from rolling off the edges and spilt liquids into the deep gutters 28. The lip 30 has its raised edges highest at the front 32 of the table's top 12 while gradually decreasing in height as it extends to the table's outer edges.

As shown in FIG. 1 the box holder 36 has several functions. The box holder 36 has been designed to interchangeably hold standard crayon boxes, many fast food restaurant french fry containers, and standard shaped drink boxes. As shown in FIG. 6 the center support 14 contains the box holder 36 at the front 32 of the lap table 10. The box holder 36 has an opening 38 in its outer side surface to function as a handle for portability.

The lap table 10 is preferably made from a lightweight thermoplastic material by an injection molding or blow molding process. It will be understood by those skilled in the art that, although the lap table 10 has been described for use by children, the same structure may be adapted for use by adults.

It is to be understood that the present invention is not limited to the embodiment described above, but encompasses any and all embodiments within the scope of the following claims.

I claim:

1. A lap table comprising:

a substantially flat kidney shaped table top, having a top surface, a bottom surface, a front edge, a rear edge, and a pair of sides, the rear edge being inwardly contoured, said top surface defining a rectangular opening position adjacent the front edge of said table top for holding a box, said front edge defining a handle opening;

a center support extending downward from the bottom surface of said table top, said center support extending from the rear edge to the front of said table top, said center support having a width defined parallel to said board and a height defined perpendicular to said board, the thickness and the height increasing from the rear edge to the front edge of the bottom surface of said table top;

wherein said center support and said bottom surface form arched joints for supporting the lap table on a user's thighs.

2. The lap table according to claim 1, wherein said top surface defines at least one cylindrical well dimensioned and configured to receive writing and drawing instruments.

3. The lap table according to claim 1, wherein said table top has at least one handle opening defined therein for portability.

4. The lap table according to claim 1, wherein said table top further comprises a raised lip about the outer periphery of the said top table top, the lip being highest at the front of said table top and gradually decreasing in height as it extends to the said sides of said table top.

5. The lap table according to claim 1, wherein said table top further comprises a gutter defined in the top surface and extending about the periphery of said table top, said gutter being shallow and thin at the front portion of said table top and increases in width and depth as it extends to the said rear edge of said table top.

6. The lap table according to claim 1, further comprising a storage compartment defined within said center support, said storage compartment being accessed through a trap door defined in the top surface of said table top.

7. The lap table according to claim 6, wherein said storage compartment further comprises a recess that is dimensioned and configured to fit a cylindrical drink cup.

* * * * *